US005991993A

United States Patent [19]

Knudson

[11] Patent Number: 5,991,993

[45] Date of Patent: Nov. 30, 1999

[54] SEAM FORMING APPARATUS FOR CONNECTING PANELS

[76] Inventor: Gary A. Knudson, 30401 Heavenly Ct., Evergreen, Colo. 80439

[21] Appl. No.: 09/041,285

[22] Filed: Mar. 12, 1998

Related U.S. Application Data

[63] Continuation-in-part of application No. 08/618,040, Mar. 18, 1996, abandoned.

[51] Int. Cl.[6] ..... B23P 11/00

[52] U.S. Cl. ..... 29/243.5

[58] Field of Search ..... 29/243.5, 243.58; 269/235; 254/134.3 PA, 139.3 CL, 139.3 R

[56] References Cited

U.S. PATENT DOCUMENTS

| | | | |
|---|---|---|---|
| 728,768 | 5/1903 | Salisbury | 254/134.3 R |
| 1,683,578 | 9/1928 | Mobius et al. | 254/134.3 R |
| 1,735,301 | 11/1929 | Short | 254/134.3 R |
| 1,794,998 | 3/1931 | Weinberger | 254/134.3 PA |
| 2,262,364 | 11/1941 | Hugel et al. | 254/134.3 R |
| 2,664,372 | 12/1953 | Hollingsworth | 254/134.3 R |
| 2,680,459 | 6/1954 | Dodson et al. | 269/235 |
| 2,786,092 | 3/1957 | Gage | 254/134.3 PA |
| 2,938,678 | 5/1960 | Hrovat | 254/134.3 PA |
| 3,478,984 | 11/1969 | Landsem | 254/134.3 R |
| 3,545,724 | 12/1970 | Wright | 254/134.3 PA |
| 3,610,191 | 10/1971 | Harris, Jr. . | |
| 3,771,482 | 11/1973 | Thompson . | |
| 3,912,226 | 10/1975 | Jackson | 254/134.3 PA |
| 3,968,952 | 7/1976 | Newell | 254/134.3 R |
| 4,027,611 | 6/1977 | Ward et al. | 29/243.5 |
| 4,324,031 | 4/1982 | Isenhoff . | |
| 4,470,186 | 9/1984 | Knudson . | |
| 4,726,107 | 2/1988 | Knudson . | |
| 4,763,393 | 8/1988 | Gee | 29/243.5 |
| 4,918,797 | 4/1990 | Watkins et al. . | |
| 4,989,308 | 2/1991 | Sanders . | |
| 5,129,637 | 7/1992 | Ito et al. | 269/235 |

*Primary Examiner*—Robert C. Watson
*Attorney, Agent, or Firm*—Ancel W. Lewis, Jr.

[57] ABSTRACT

Portable apparatus for connecting panels with an interlocking seam is disclosed. The apparatus includes three rollers disposed in a triangular configuration. Two guide rollers support connecting flange portions of the panels and a forming or hem roller turns a terminal section of one connecting flange portion back to form the seam. A larger hem roller reduces forming stresses and improves quality. Apparatus also connects panels by seaming a cap over adjacent connecting flange portions. The apparatus may be manually driven or motor driven.

18 Claims, 4 Drawing Sheets

SEAM FORMING APPARATUS FOR CONNECTING PANELS

This application is a continuation-in-part of application Ser. No. 08/618,040 filed Mar. 18, 1996, now abandoned.

TECHNICAL FIELD

The present invention generally relates to panel connecting apparatus and more particularly to apparatus for seaming panels at an interlocking seam that is suitable for job site construction.

BACKGROUND ART

Seaming apparatus connect side edge portions of adjacent panels with an interlocking seam. Seaming apparatus heretofore provided include rollers that bend a side edge portion or terminal section of connecting flange portions of two adjacent panels, and opposed guide rollers that support the side edge portions and oppose the force of the seaming operation perpendicular to the axis of travel. The seaming operation creates a reactive force on the forming rollers opposite the direction of travel, so a forming roller must be rigidly fixed relative to the seamer along this axis. In order to provide consistent, quality seams, the forming rollers and guide rollers require fixed, rigid positioning relative to each other both in the direction of travel and perpendicular to the direction of travel.

Seamers heretofore provided have been patterned after conventional roll-forming apparatus. Typical features of prior known seamers include pairs of directly opposed rollers and multiple, sequential roller pairs. Since a single pair of directly opposed rollers is inherently unstable, prior known seamers have at least two pairs of rollers. Seamers with multiple, sequential roller pairs are disclosed U.S. Pat. No. 3,610,191 to Harris, U.S. Pat. No. 3,771,482 to Thompson, U.S. Pat. No. 4,324,031 to Isenhoff, U.S. Pat. No. 4,918,797 to Watkins et al., and U.S. Pat. No. 4,726,107 to applicant.

In prior known seamers, the pairs of rollers are often progressive from one pair to the next, making the seamer unidirectional. A seamer with progressive rollers cannot seam to the end of the panels and can only seam to a point relative to the end of the panels equal to the distance between the leading and the last roller pair. If the pairs of rollers are not progressive, the seamer can be bi-directional but the seamer includes duplicate, redundant roller pairs. Bi-directional seamers are disclosed in U.S. Pat. No. 4,989,308 to Sanders and U.S. Pat. No. 4,470,186 to applicant.

Prior known devices that relate to stringing power cables have used a triangular three roller configuration and include U.S. Pat. No. 728,768 to Salisbury and U.S. Pat. No. 2,786,092 to Gage. The device in Salisbury would not be suitable for seaming panels since the device does not have a fixed operating position for the single roller and cannot provide uniformity between seams on different panels. Also, the forming force parallel to the direction of seamer travel would rotate the single roller away from the other rollers in the Salisbury device. The device in Gage uses a spring to bias the single roller toward the opposing pair of rollers so that the seam shape with the Gage device would be dependent on the speed the device is moved along the panels edges. The Gage device does not have a fixed operating position for the single roller and would not be suitable for seaming panels.

DISCLOSURE OF THE INVENTION

In accordance with the present invention there is provided a portable seaming apparatus particularly suited for forming at least one terminal section of the connecting flange portions or of a cap disposed over the connecting flange portions of two adjacent building panels into an interlocking seam at the job site. The panel seaming apparatus disclosed has a support plate on which spaced first and second rollers and an opposed larger third roller are mounted. When moved along the connecting flange portions of two adjacent panels the third roller turns a terminal section of a connecting flange portion down and in to connect, or lock, the panels together along a continuous interlocking seam. The seaming apparatus may also seam a pair of opposed terminal sections of a cap over adjacent panel connecting flange portions.

BRIEF DESCRIPTION OF THE DRAWINGS

Details of this invention are described in connection with the accompanying drawings that bear similar reference numerals in which:

FIG. 8 is an enlarged view of the hem and one guide roller in the extended operating position and showing the terminal section turned down and in.

DETAILED DESCRIPTION OF THE INVENTION

Figure 1:
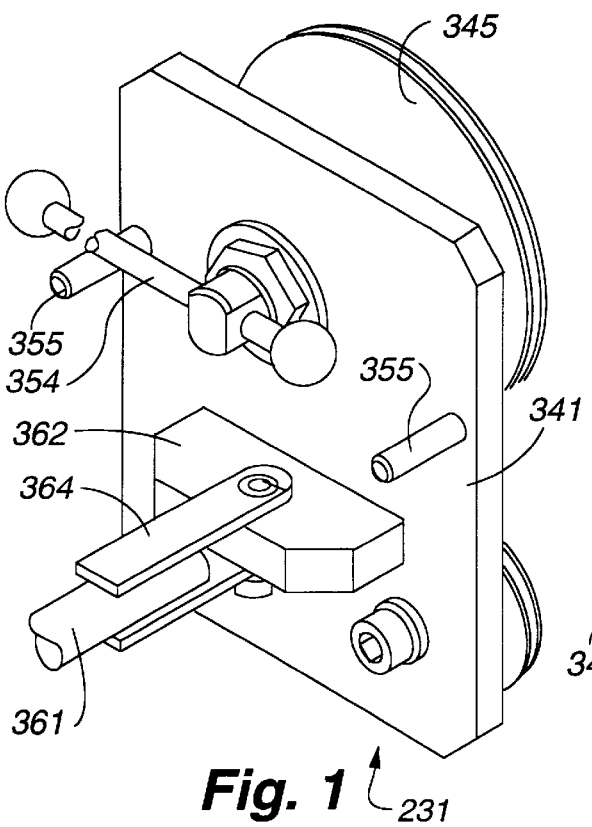
FIG. 1 is a rear perspective view of a panel seaming apparatus embodying features of the present invention.
Figure 2:
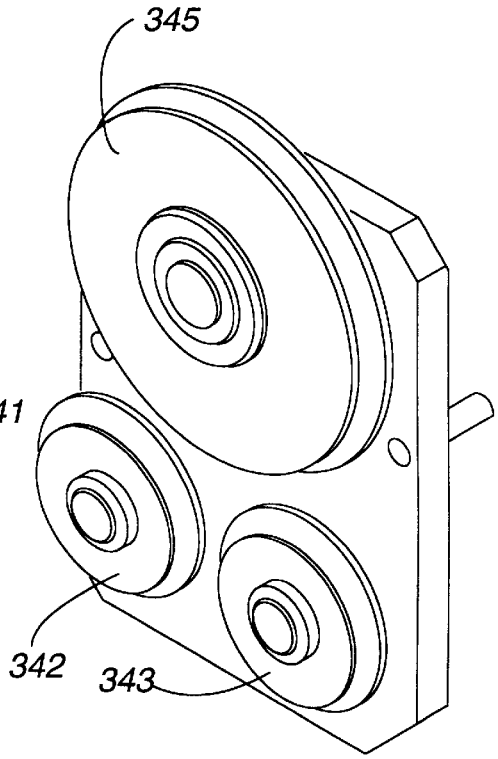
FIG. 2 is a front perspective view of the apparatus shown in FIG. 1.

Referring now to FIGS. 1–8, panel connecting apparatus 231 having opposed rollers 345 and 342, 343 operates so that as the connecting apparatus 231 is moved along the panels it turns the terminal section 211 down back into the opening in the outturned flange connecting portion 205 to form a continuous seam.

Panel connecting apparatus 231 shown in FIGS. 1–8 includes a support plate 341 on which there are mounted two spaced tracking or guide rollers 342 and 343 and a hem roller 345 opposite and between guide rollers 342 and 343 and between which the connecting flange portions of two panels to be connected are positioned. Each guide roller is mounted on a shaft 344. Each guide roller is mounted on a roller bearing 377 carried on shaft 344 with a through bore 378. A threaded bolt 379 extends through an elongated hole 381 in the support plate, through the through bore 378 of the shaft and has a nut 382 threaded on the end of bolt 379 opposite an socket head 383. A set screw 384 extends up through the end of the plate and bears against the bolt to enable vertical adjustment of the rollers 342 and 343 relative to the plate 341. This allows slight adjustments of positions of the rollers 342 and 343 relative to hem roller 345 for different types and thicknesses of metals. Each guide roller has a shaped peripheral guide groove 340 bounded on each side by rounded peripheral portions 343*a* and 343*b* of different diameters with the larger diameter portion 343*a* serving as a back stop for the panel connecting flange portion to guide the panel.

The hem roller 345 has a peripheral seaming groove 346 that is narrower than the guide grooves 340 and is bounded on each side by rounded peripheral portions 346*a* and 346*b* of different diameters with the groove 346 serving to fold the terminal section 211 of the panel down and in. The larger diameter portion 346*a* serves as a back stop for the panel connecting flange portion to position the panel in place. The hem roller 345 is mounted for free rotation on a shaft 347 that extends through a hole in plate 341 and is supported to rotate about an axis 348. The shaft 347 has a flange 349 that butts against one side of the plate 341 and a threaded portion 351 with a spring washer 352 and lock nut 353 to secure the shaft to the plate 341. This assembly on shaft 347 provides resistance to movement for the shaft 347 as the shaft is rotated. A transverse handle 354 extends through a hole in the rear end of the shaft 347 which permits manual rotation of the shaft about its axis 348. A stop pin 355 affixed to the plate on each side of the shaft 347 limits the extent of the rotational movement of the handle 354.

Figure 4:
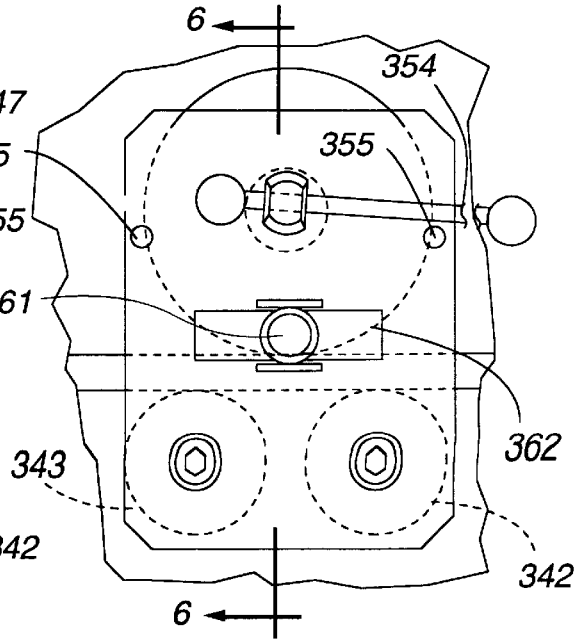
FIG. 4 is a fragmentary rear elevational view of the apparatus with the handle and hem roller in an extended operating position.
Figure 5:
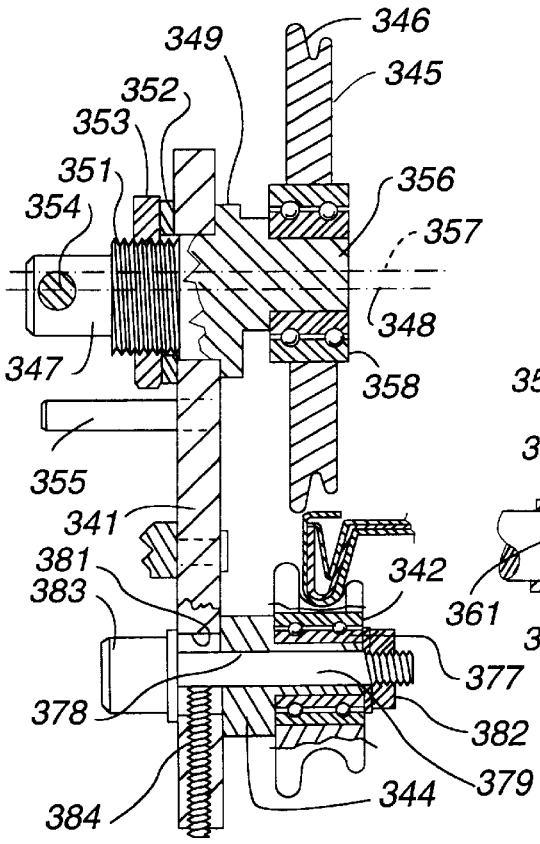
FIG. 5 is a sectional view taken along line 5—5 of FIG. 3.
Figure 6:
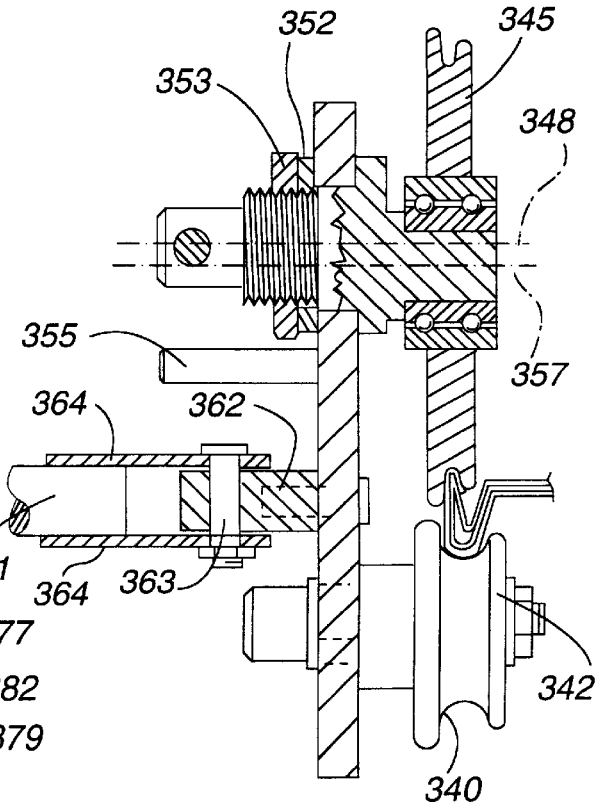
FIG. 6 is a sectional view taken along line 6—6 of FIG. 4.
Figure 7:
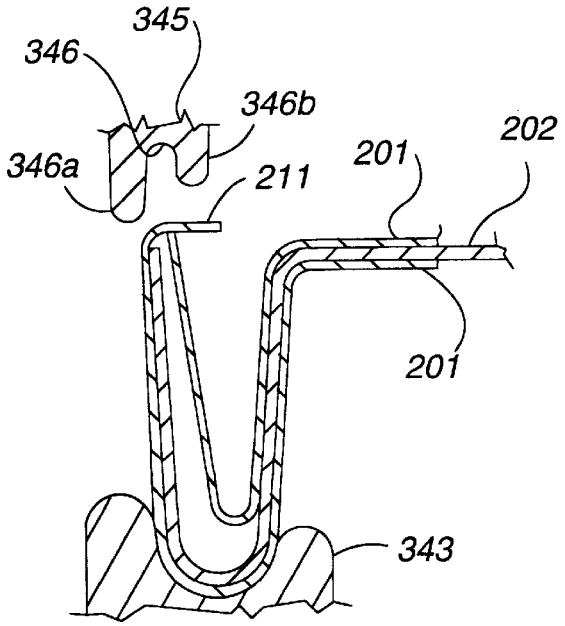
FIG. 7 is an enlarged view of the hem and one guide roller in the retracted position and the associated flange connecting portions of the three panels being connected.

The shaft 347 has an offset or eccentric section 356 with a center along axis 357 that is spaced a selected distance from axis 348. A roller bearing 358 mounts on the eccentric section 356 with the hem roller 345 being mounted on the bearing 358. In this way when the shaft 347 is rotated about axis 348 the hem roller 345 will move toward the guide rollers 342 and 343 to an operating position and back to a retracted position. When the handle 354 is moved to an over-center position about 10 degrees past a horizontal position as seen in FIG. 4 the hem roller is in the operating position to turn down the panel terminal section 211 to join the panels as is seen in FIG. 6. The over-center position shown is a locking position for the handle and shaft so the hem roller will not retract during the hemming operation. The reverse retracted position for the handle against the opposite pin 355 is also an over-center locking position.

A handle 361 is pivotally mounted to the support plate 341 by means of a flange 362 on the plate, a pivot bolt 363 and two plates 364 that fasten to the handle, fit over the flange and are pivotally connected by the bolt 363. This allows the handle to swing from side to side. The handle 361 enables the user to manually move the panel connecting apparatus 231 along the panels.

Figure 8:
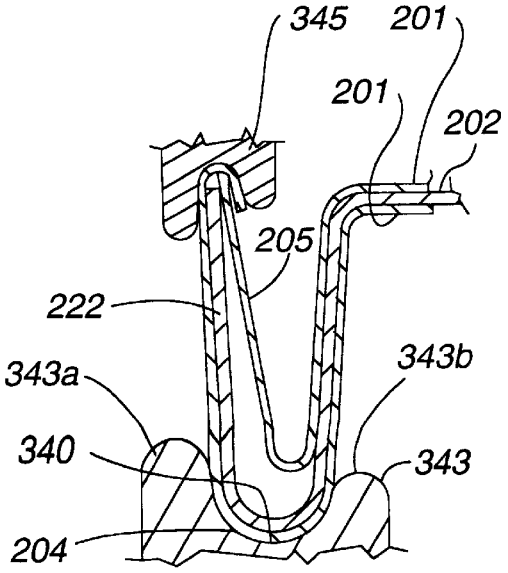

As seen in FIG. 8 the outer surface of the curved bend of an inturned connecting flange portion 204 of a skin panel 201 is disposed in the groove 340 of the guide rollers 342 and 343. The transverse connecting flange portion 222 of a frame panel 202 and outturned connecting flange portion 205 of a second seam panel 201 nest in flange portion 204, and the terminal section 211 is folded back and against the end portions of flange portions 222 and 205 to form a hem that connects, seams or locks the three members together along a continuous seam.

The hem roller 345 is made larger than the guide rollers 342 and 343. In the embodiment shown the hem roller has an O.D. of 5.5 inches and the guide rollers have an O.D. of 2.75 inches or a ratio of two to one. A range of ratio of diameters of hem roller to each guide roller of 1.5:1 up to 5:1 would be suitable. A larger diameter hem roller contacts the flange sooner, minimizes bending resistance, and rolls it through a longer arc thereby generating a gentler bending process. Further, less force is required to push the apparatus along the panel.

Figure 3:
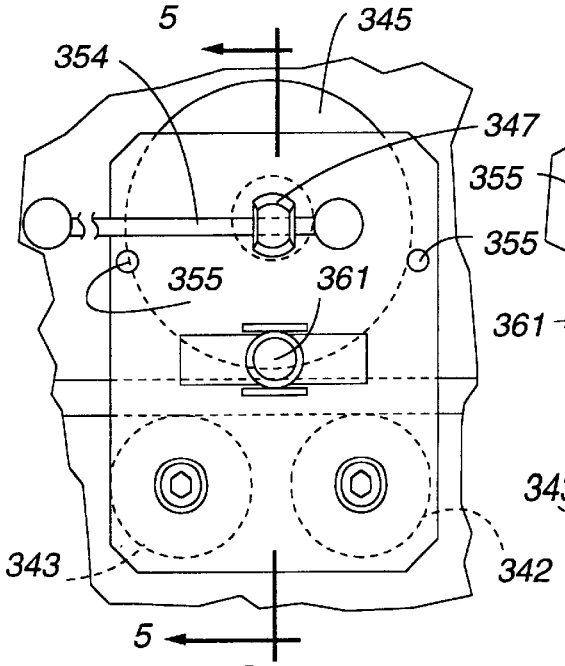
FIG. 3 is a fragmentary rear elevational view of the apparatus shown in FIGS. 1 and 2 with the handle and hem roller in the retracted position.

The two smaller spaced guide rollers 342, 343 provide stability for the apparatus. The two guide rollers 342, 343 in combination with the static side of the connecting flange portions 204, 205, 222 act as a rigid body to oppose the perpendicular bending force of hem roller 345. The guide rollers 342, 343 must be spaced close enough together so that the connecting flange portions do not bow away from hem roller 345 during the seaming process and so that the connecting flange portions are not bent by the seaming process. The apparatus can seam up to a distance from the end of the panels equal to the distance along the seaming axis between the point of contact with the connecting flange portions of one guide roller and the point of contact of the hem roller. Referring to FIG. 3, this distance is the same as the horizontal distance between the center of hem roller 345 and the center of guide roller 343, or, since the guide rollers are symmetrically disposed relative to the hem roller, one half the distance between the centers of the guide rollers. The guide rollers 342, 343 are spaced close together to allow seaming closer to the end of the panel. As shown in FIG. 3, even with the guide roller closely spaced, the triangle formed by the points of contact of the guide rollers and hem roller with the connecting flange portions has an upper angle greater than 90 degree and the apparatus is very stable.

Although an eccentric shaft is used in the preferred embodiment, other means can be used to move the hem roller 345 between the retracted position and the fixed operating position, and other means can be used to lock the hem roller at the fixed operating position. The apparatus requires that the hem roller be movable to a retracted position for attachment and removal from the seam. The seamer must move the hem roller to a consistent operating position for consistency between seams on different panels. The hem roller must lock in the operating position, and be immovable to opposing forces perpendicular and parallel to the forming axis in order to provide a quality seam. Toggle clamps or standard fasteners can be used instead of the eccentric shaft to move and lock the hem roller.

Figure 9:
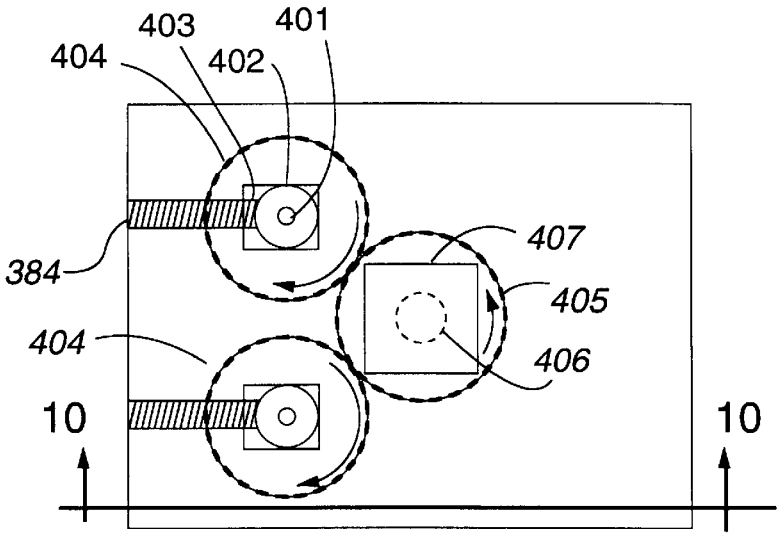
FIG. 9 is a rear elevational view of modified apparatus with a drive motor coupled to the guide rollers.
Figure 10:
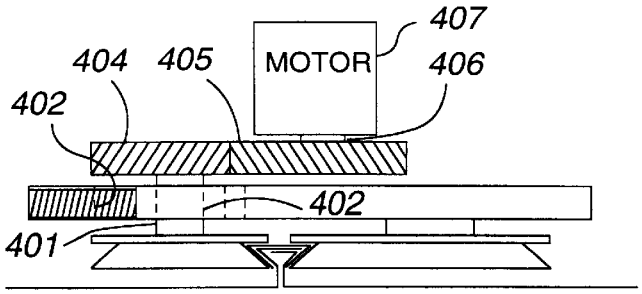
FIG. 10 is a sectional view taken along line 10—10 of FIG. 9.

The seamer shown in FIGS. 1–8 is manually pushed along a seam. The seamer can readily be linked to an electric or hydraulic drive motor for automatic or hands free operation. Referring now to FIGS. 9–10, guide rollers 342 and 343 are each fixedly mounted on a shaft 401. Each shaft 401 is mounted on a roller bearing 402 mounted in an elongated hole 403 in support plate 341. Set screws 384 extend up through the end of plate 341 and bear against bearings 402 to enable vertical adjustment of the roller 342 and 343 relative to the plate 341. A spur gear 404 is mounted on each shaft 401. Drive gear 405 is mounted on output shaft 406 of drive motor 407 and meshes with both spur gears 404 to rotate both shafts 401 to rotate guide rollers 342 and 343 and drive the apparatus along the seam.

Figure 11:
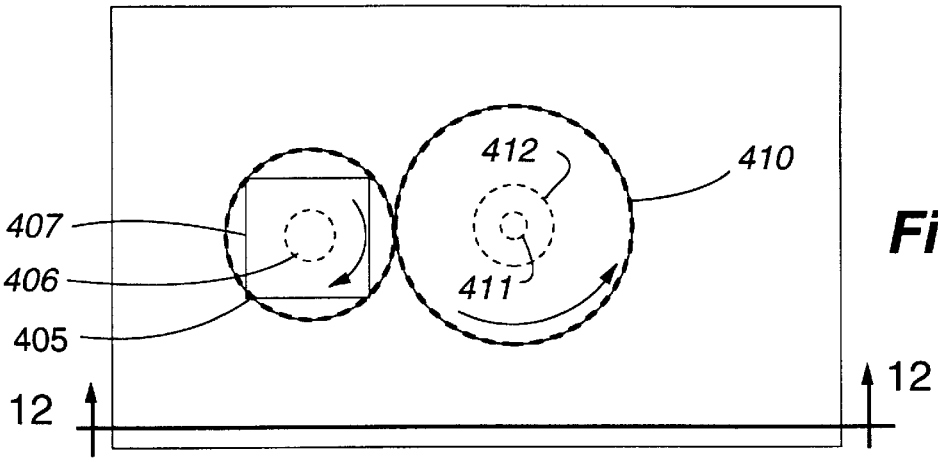
FIG. 11 is a rear elevational view of another modified apparatus with a drive motor coupled to the third roller.
Figure 12:
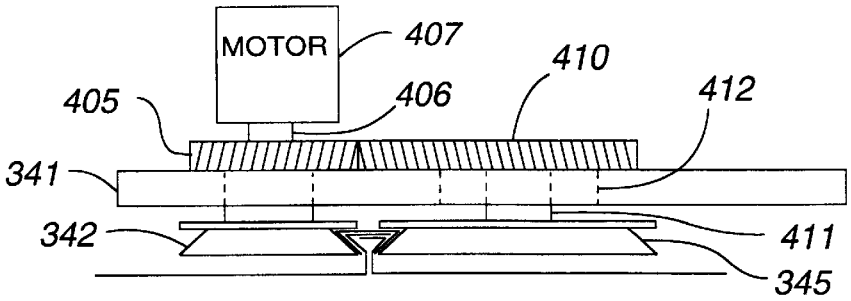
FIG. 12 is a sectional view taken along line 12—12 of FIG. 11.

Referring to FIGS. 11–12, an alternative drive means is shown. Drive motor 407 is rigidly mounted to support plate 341. Drive gear 405 is mounted on output shaft 406 of drive motor 407. Drive gear 405 is drivably coupled to spur gear 410 which is fixedly mounted to shaft 411. Shaft 411 extends through eccentric shaft 347 and is rotably mounted in bearing 412 which is mounted in shaft 347. Hem roller 345 is fixedly attached to shaft 411 so that actuation of drive motor 407 rotates drive gear 405 which drives spur gear 410, rotating shaft 411 and hem roller 345, driving the apparatus along the seam.

Figure 13:
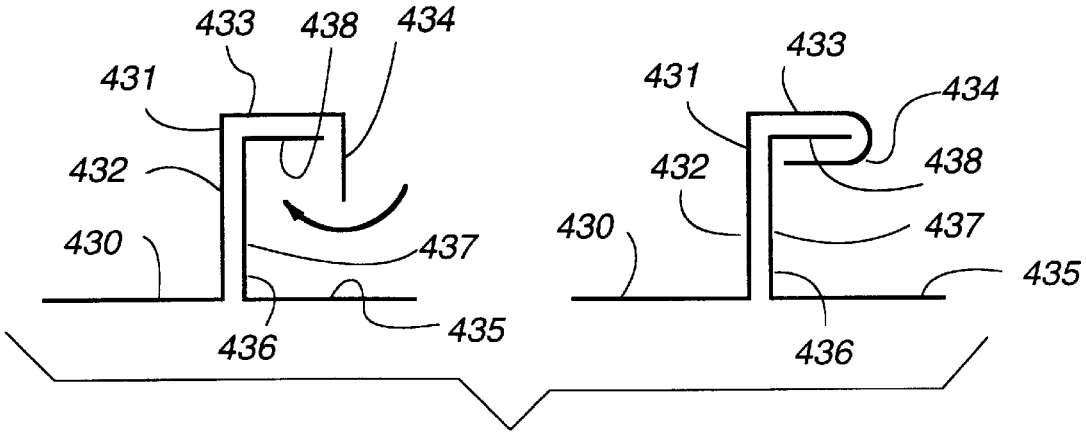
FIG. 13 is a sectional view of two adjacent panels showing seaming of the connecting flange portions.

An alternative seaming configuration for two panels is shown in FIG. 13. A first connecting flange 431 is provided at the extremity of first panel 430. First connecting flange 431 is generally J-shaped. A first section 432 of first connecting flange 431 attaches to and extends perpendicular to first panel 431, corresponding to the long leg of a J. A second section 433 attaches to first section 432 at the end opposite first panel 431, extending perpendicular to first section 432 away from first panel 431, resembling the bottom part of a J. Backturned terminal section 434 attaches to and extends perpendicular to second section 433 toward first panel 431, corresponding to the short leg of a J.

An L-shaped second connecting flange 436 is provided at the extremity of second panel 435. First section 437 extends perpendicular to second panel 435 and backturned second section 438 extends perpendicular to first section 437 toward second panel 435. First panel 430 and second panel 435 are connected by nesting second connecting flange 436 inside first connecting flange 431 and turning terminal section 434 of first connecting flange 431 back to form a seam.

Guide rollers 432 and 433 are modified for this alternative seaming configuration. Each guide roller has an L-shaped peripheral guide groove 440 bounded on one side by rounded peripheral portion 441 which serves as a back stop for panel connecting flange 431 to guide the panel.

Figure 14:
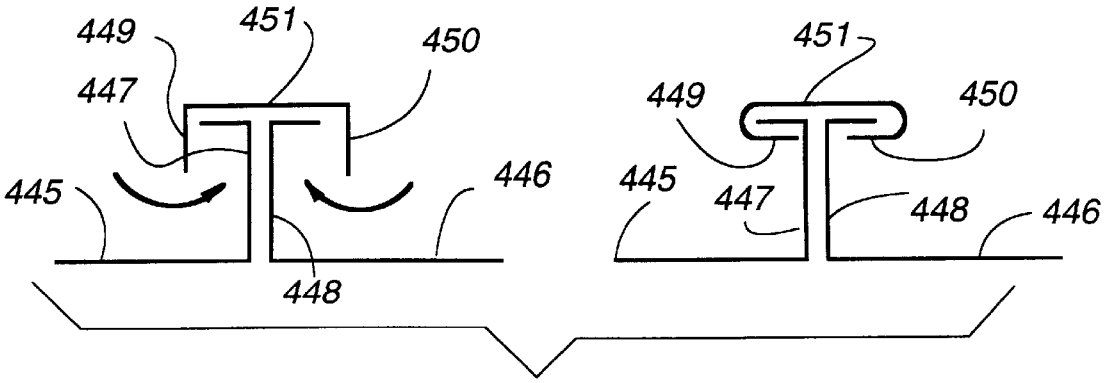
FIG. 14 is a sectional view of two adjacent panels showing seaming of a cap over the connecting flange portions.
Figure 15:
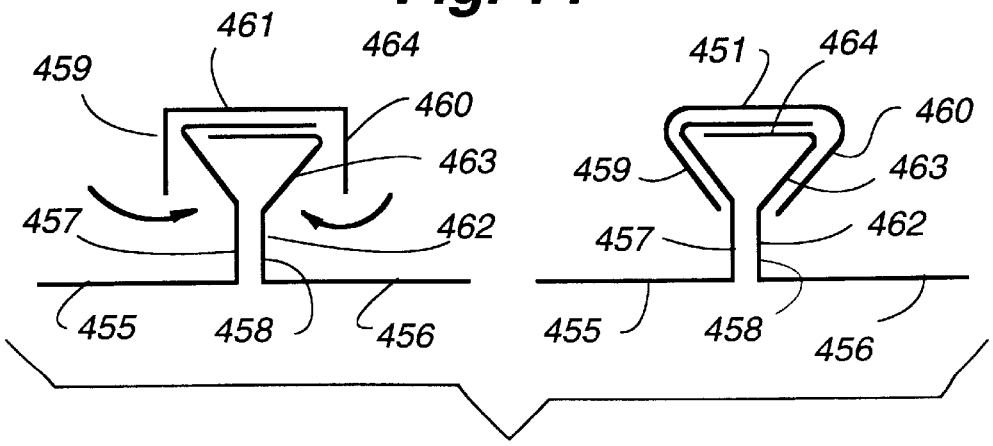
FIG. 15 is a sectional view of two adjacent panels showing seaming of an alternative cap over the connecting flange portions.

The seamer can also seam a cap over adjacent panel flanges, as shown in FIGS. 14 and 15. In FIG. 14 first and second panels 445 and 446 are provided with backturned L-shaped panel connecting flanges 447 and 448. First terminal section 449 and second terminal section 450 form the legs of a U-shaped cap 451 which is set over panel connecting flanges 447 and 448. Guide rollers 342 and 343 each have a U-shaped peripheral seaming groove to fold the first terminal section 449 of cap 451 up and in over connecting panel flange 447. Hem roller 345 has a U-shaped peripheral seaming groove to fold the second terminal section 450 of cap 451 down and in over connecting panel flange 448.

In FIG. 15 first and second panels 455 and 456 are provided with first and second panel connecting flanges 457 and 458. Connecting flanges 457 and 458 each have a first section 462 perpendicular to the panel, a second section 463 extending at an angle outwardly and backwardly from first section 462 and a third section 464 extending forwardly from second section 463 parallel to the panel. First sections 462 of connecting flanges 457 and 458 are butted together with the third section 464 of one flange overlying the third section 464 of the other flange. First terminal section 459 and second terminal section 460 form the legs of a U-shaped cap 461 which is set over connecting panel flanges 457 and 458. Guide rollers 342 and 343 each have a peripheral seaming groove to fold the first terminal section 459 of cap 461 up and in over connecting panel flange 457. Hem roller 345 has a peripheral seaming groove to fold the second terminal section 460 of cap 461 down and in over connecting panel flange 458.

Although the present invention has been described with a certain degree of particularity, it is understood that the present disclosure has been made by way of example and that changes in details of structure may be made without departing from the spirit thereof.

What is claimed is:

1. Apparatus for forming an interlocking seam on two adjacent panels having adjacent connecting flange portions comprising:

a support, spaced first and second rollers, and a third roller opposite, spaced from, and between said first and second rollers, said rollers being arranged in a triangular configuration on said support for bending a first terminal section extending along said panels disposed between said first and second rollers and said third roller to form an interlocking seam with said connecting flange portions as said rollers move along said panels, means for moving said third roller between a retracted position and a fixed operating position, said means for moving said third roller including a shaft mounted for rotation about a first axis on said support, said shaft having an eccentric section with a second axis off center to said first axis, said third roller being mounted on said eccentric section for rotation about said second axis, said third roller being moved from a retracted position to a fixed operating position by rotation of said shaft, and means for locking said third roller in said fixed operating position, said means for locking said third roller including means for stopping said shaft in an over-center position.

2. Apparatus as set forth in claim 1 wherein said means for stopping said shaft includes a handle mounted on said shaft perpendicular to said first axis and a stop pin mounted on said support that limits rotational movement of said handle at said over-center position.

3. Apparatus as set forth in claim 1 wherein the diameter of said third roller is on the order of about twice the diameter of each of said first and second rollers to facilitate easier and smoother bending of said terminal section.

4. Apparatus as set forth in claim 1 wherein said third roller has a peripheral groove to fit against an outer side of said terminal section to fold said terminal section back to form an interlocking seam.

5. Apparatus as set forth in claim 1 wherein the diameter of said third roller is in the range of about 1.5 to 5 to the diameter of each of said first and second rollers.

6. Apparatus as set forth in claim 1 including means for selectively moving each of said first and second rollers relative to said support to adjust the spacing between said third roller and said first and second rollers.

7. Apparatus as set forth in claim 4 wherein said means for selectively moving includes first and second set screws mounted in said support such that turning said set screws moves said first and second rollers.

8. Apparatus as set forth in claim 1 further including means for moving said support and said first, second and third rollers along said panels while forming said interlocking seam.

9. Apparatus as set forth in claim 8 wherein said means for moving includes a manually operable push handle.

10. Apparatus as set forth in claim 8 wherein said means for moving includes a drive motor mounted on said support, said motor coupled to and driving said first and second rollers.

11. Apparatus as set forth in claim 8 wherein said means for moving includes a drive motor mounted on said support, said motor coupled to and driving said third roller.

12. Apparatus as set forth in claim 1 wherein said support is in the form of a flat plate.

13. Apparatus as set forth in claim 1 wherein said first terminal section extends from said connecting flange portion of one of said panels and said third roller bends said first terminal section over said connecting flange portion of said other panel to form said interlocking seam.

14. Apparatus as set forth in claim 1 wherein said first terminal section and a second terminal section are a pair of parallel spaced legs transverse to and connected by an intermediate wall portion of a cap disposed on said connecting flange portions, said third roller bending said first terminal section and said first and second rollers bending said second terminal section over said connecting flange portions to form said interlocking seam.

15. Seaming apparatus for forming an interlocking continuous seam on two panels having adjacent connecting flange portions comprising:

a flat support plate with a first face and a second face opposite said first face, spaced first and second shafts mounted on and extending perpendicular to said first face, first and second set screws mounted in said support plate, said first and second set screws bearing against and moving said first and second shafts respectively for adjustment for different types and thicknesses of panels, first and second rollers rotably mounted on said first and second shafts respectively, said first and second rollers each having a peripheral groove bounded by a rounded first peripheral portion near said first face and a rounded second peripheral portion away from said first face, said first peripheral portion being a larger diameter than said second peripheral portion, a third shaft mounted through said support plate for rotation about a first axis, said third shaft being located between said first and second shafts and spaced from said first and second shafts, said first second and third shafts being arranged in a triangular configuration, said third shaft having an eccentric portion extending out from said first face with a second axis off center to said first axis and a rear portion extending out from said second face, a third roller mounted on said eccentric portion for rotation about said second axis, said third roller being moved from a retracted position to a fixed operating position by rotation of said third shaft and being locked in said fixed operating position by rotation of said third shaft to an over-center position, said third roller being larger than said first and second rollers by a ratio of between about 1.5 to 5, said third roller having a peripheral groove bounded by a rounded first peripheral portion near said first face and a rounded second peripheral portion away from said first face, said first peripheral portion being a larger diameter than said second peripheral portion to form a back stop for the connecting flange portions, said third roller for moving against a terminal section to turn the terminal section back over one of said connecting flange portions to form said interlocking seam, a first handle mounted on said rear portion of said third shaft for rotation of said third shaft, first and second stop pins mounted on said plate extending out from said second face on opposite sides of said third shaft, said first and second stop pins limiting rotational movement of said first handle to said retracted position and to said over-center position respectively, and a second push handle pivotally mounted to said plate extending out from said second face to move said support plate and rollers along said panels to form said interlocking seam.

16. Seaming apparatus for forming an interlocking continuous seam on adjacent first and second connecting flange portions of two adjacent panels comprising:

a support, spaced first and second rollers rotably mounted on said support, said first and second rollers bearing against one of said connecting flange portions, a third roller mounted for rotation on said support between said first and second rollers and spaced from said first and second rollers, said first, second and third rollers being disposed in a triangular configuration, said third roller for moving against a terminal section of one of said connecting flange portions to turn said terminal section back to form the interlocking seam, means for moving said third roller between a retracted position and a fixed operating position, said means for moving said third roller including a shaft mounted for rotation about a first axis on said support, said shaft having an eccentric section with a second axis off center to said first axis, said third roller being mounted on said eccentric section for rotation about said second axis, said third roller being moved from a retracted position to a fixed operating position by rotation of said shaft, and means for locking said third roller in said fixed operating position, said means for locking said third roller including means for stopping said shaft in an over-center position.

17. Seaming apparatus for forming an interlocking continuous seam on a cap having parallel spaced first and second terminal sections transverse to and connected by an intermediate wall portion and with said cap disposed over adjacent connecting flange portions of two panels comprising:

a support, spaced first and second rollers rotably mounted on said support, said first and second rollers for moving against said first terminal section of said cap to turn said first terminal section back, a third roller mounted for rotation on said support between said first and second rollers and spaced from said first and second rollers, said first, second and third rollers being disposed in a triangular configuration, said third roller for moving against said second terminal section to turn said second terminal section back to form the interlocking seam, means for moving said third roller between a retracted position and a fixed operating position, said means for moving said third roller including a shaft mounted for rotation about a first axis on said support, said shaft having an eccentric section with a second axis off center to said first axis, said third roller being mounted on said eccentric section for rotation about said second axis, said third roller being moved from a retracted position to a fixed operating position by rotation of said shaft, and means for locking said third roller in said fixed operating position, said means for locking said third roller including means for stopping said shaft in an over-center position.

18. Apparatus for forming an interlocking seam on two adjacent panels having adjacent connecting flange portions comprising:

a support, spaced first and second rollers, and a third roller opposite, spaced from, and between said first and second rollers, said rollers being arranged in a triangular configuration on said support for bending a first terminal section extending along said panels disposed between said first and second rollers and said third roller to form an interlocking seam with said connecting flange portions as said rollers move along said panels, means for moving said third roller between a retracted position and a fixed operating position, and means for locking said third roller in said fixed operating position, said third roller having a larger diameter along one side to form a stop for said flange connecting portions.

* * * * *